US010442213B2

(12) United States Patent
Nishimura et al.

(10) Patent No.: US 10,442,213 B2
(45) Date of Patent: Oct. 15, 2019

(54) DRYING DEVICE, LIQUID DISCHARGE APPARATUS, AND TREATMENT LIQUID APPLICATOR

(71) Applicants: Hideaki Nishimura, Kanagawa (JP); Toshihiro Yoshinuma, Kanagawa (JP); Wataru Sakamoto, Broomfield, CO (US); Sho Sawahata, Tokyo (JP); Ken Onodera, Kanagawa (JP)

(72) Inventors: Hideaki Nishimura, Kanagawa (JP); Toshihiro Yoshinuma, Kanagawa (JP); Wataru Sakamoto, Broomfield, CO (US); Sho Sawahata, Tokyo (JP); Ken Onodera, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/040,007

(22) Filed: Jul. 19, 2018

(65) Prior Publication Data

US 2019/0100031 A1 Apr. 4, 2019

(30) Foreign Application Priority Data

Sep. 29, 2017 (JP) ..... 2017-191707

(51) Int. Cl.
*B41J 11/00* (2006.01)
*B41J 29/377* (2006.01)
(Continued)

(52) U.S. Cl.
CPC ..... *B41J 11/002* (2013.01); *B41F 23/0443* (2013.01); *B41J 2/1408* (2013.01); *B41J 29/377* (2013.01); *B41J 2202/08* (2013.01)

(58) Field of Classification Search
CPC ..... B41J 11/002; B41J 2/1408; B41J 29/377; B41J 2202/08; B41F 23/0443
See application file for complete search history.

(56) References Cited

U.S. PATENT DOCUMENTS 6,425,329 B1 * 7/2002 Crystal ..... B41J 11/001 101/424.1
2010/0110156 A1 * 5/2010 Hara ..... B41J 2/155 347/102
(Continued)

FOREIGN PATENT DOCUMENTS

JP 2013-039721 2/2013
JP 2014-040053 * 3/2014 ..... B41J 2/01
(Continued)

*Primary Examiner* — Henok D Legesse
(74) *Attorney, Agent, or Firm* — Oblon, McClelland, Maier & Neustadt, L.L.P.

(57) ABSTRACT

A drying device includes a plurality of blowers to blow air onto an object to be dried, the plurality of blowers being disposed along a direction of conveyance of the object to be dried, and a plurality of heaters to heat air inside the plurality of blowers. Each of the plurality of blowers includes an elongated nozzle arranged along a nozzle direction perpendicular to the direction of conveyance of the object to be dried, and an airflow generator to generate airflow to be blown from the elongated nozzle. The plurality of blowers includes a first blower including the airflow generator at a first end of the first blower in the nozzle direction and a second blower including the airflow generator at a second end of the second blower opposite the first end in the nozzle direction.

10 Claims, 8 Drawing Sheets

(51) Int. Cl.
*B41F 23/04* (2006.01)
*B41J 2/14* (2006.01)

(56) References Cited

U.S. PATENT DOCUMENTS

| | | | | |
|---|---|---|---|---|
| 2013/0194367 | A1* | 8/2013 | Chiwata ..... | B41J 11/0015 347/102 |
| 2014/0210919 | A1 | 7/2014 | Walker et al. | |
| 2017/0173974 | A1 | 6/2017 | Hoshino et al. | |
| 2017/0266991 | A1 | 9/2017 | Onodera et al. | |
| 2018/0141348 | A1 | 5/2018 | Hoshino et al. | |

FOREIGN PATENT DOCUMENTS

| | | |
|---|---|---|
| JP | 2014-148168 | 8/2014 |
| JP | 2016-168805 | 9/2016 |
| JP | 2018-066552 | 4/2018 |

* cited by examiner

DRYING DEVICE, LIQUID DISCHARGE APPARATUS, AND TREATMENT LIQUID APPLICATOR

CROSS-REFERENCE TO RELATED APPLICATIONS

This patent application is based on and claims priority pursuant to 35 U.S.C. § 119(a) to Japanese Patent Application No. 2017-191707, filed on Sep. 29, 2017, in the Japan Patent Office, the entire disclosure of each of which is hereby incorporated by reference herein.

BACKGROUND

Technical Field

Aspects of the present disclosure relate to a drying device, a liquid discharge apparatus, and a treatment liquid applicator.

Related Art

As a printer that performs printing by applying a liquid to a recording medium such as a roll of paper, a continuous sheet of paper, and a belt-like continuous body (web), there is a printer that includes a drying device to promote drying of the liquid applied to the medium.

Such a printer includes a plurality of heaters elongated in a direction orthogonal to a direction of travel of the medium to be heated and a plurality of blowers each having an elongated nozzle extending in a direction orthogonal to the direction of travel of the medium to be heated. The plurality of heaters and the plurality of blowers are alternately arranged along the direction of travel of the medium to be heated. Air warmed by the plurality of heaters is blown onto the medium to be heated from the nozzles of the plurality of blowers.

SUMMARY

In an aspect of this disclosure, a novel drying device includes a plurality of blowers to blow air onto an object to be dried, the plurality of blowers being disposed along a direction of conveyance of the object to be dried, and a plurality of heaters to heat air inside the plurality of blowers. Each of the plurality of blowers includes an elongated nozzle arranged along a nozzle direction perpendicular to the direction of conveyance of the object to be dried, and an airflow generator to generate airflow to be blown from the elongated nozzle. The plurality of blowers includes a first blower including the airflow generator at a first end of the first blower in the nozzle direction and a second blower including the airflow generator at a second end of the second blower opposite the first end in the nozzle direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
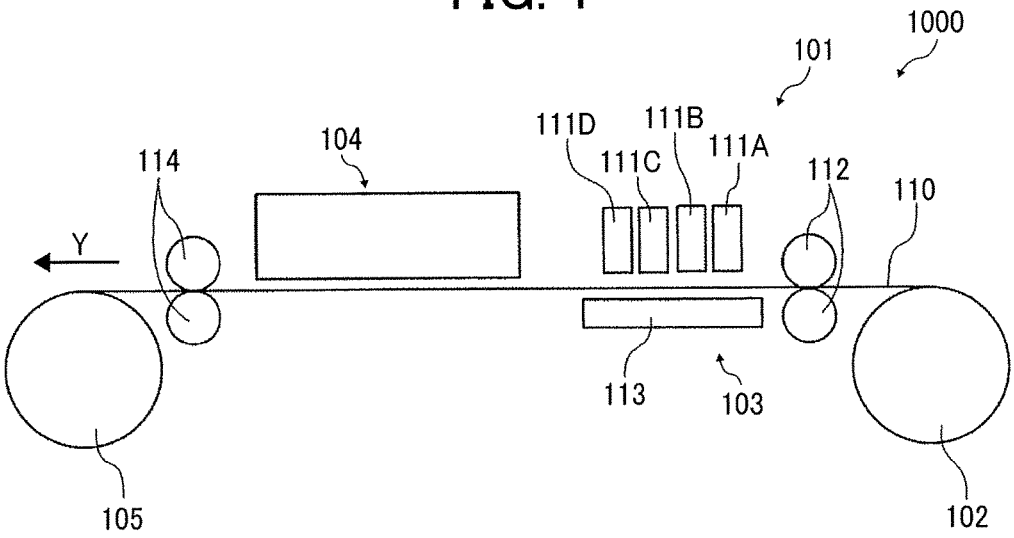
FIG. 1 is a schematic front view of a printer as a liquid discharge apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views. First, an example of a printer 1000 as a liquid discharge apparatus according to the present disclosure will be described with reference to FIG. 1. FIG. 1 is a schematic cross-sectional view of the printer 1000.

The printer 1000 is an inkjet recording apparatus and includes a liquid applicator 101. The liquid applicator 101 includes a plurality of liquid discharge heads 111A, 111B, 111C, and 111D that is a liquid applying means for discharging ink, which is a liquid of a required color, onto a continuous sheet 110. The continuous sheet 110 is variously a member (medium) to be transported, a member to be transported, an object to be heated, or an object to be dried.

The liquid applicator 101 includes, for example, full-line type of the plurality of liquid discharge heads 111 of four colors, disposed in an order of black (K), Cyan (C), Magenta (M), and Yellow (Y) from the upstream side in a direction of conveyance (indicated by arrow Y in FIG. 1) of the continuous sheet 110. Note that the number and types of color are not limited to the above-described four colors of K, C, M, and Y and may be any other suitable number and types of colors.

The continuous sheet 110 fed from a feeding roller 102 is sent to a conveyance guide 113, which is disposed to face the liquid applicator 101, by conveyance rollers 112 of a conveyance unit 103 and is conveyed to a position facing the liquid applicator 101 by being guided by the conveyance guide 113.

The continuous sheet 110 onto which the liquid is applied by the liquid applicator 101 is sent by ejection rollers 114 through a drying device 104 according to the present embodiments, and is wound around a winding roller 105.

Figure 2:
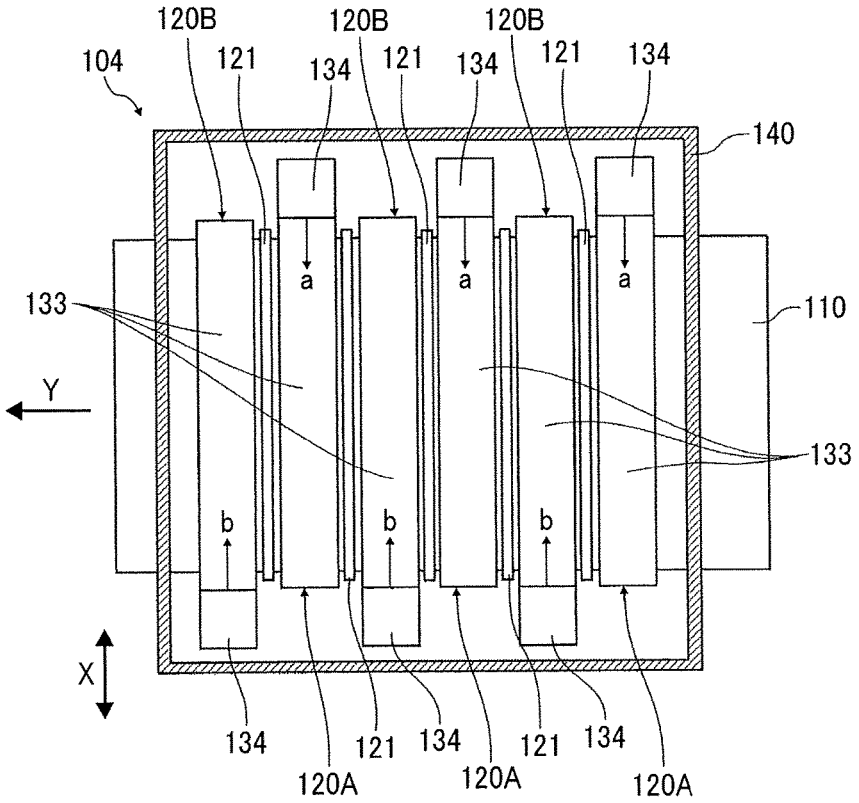
FIG. 2 is a plan view of a drying device according to a first embodiment of the present disclosure.
Figure 3:
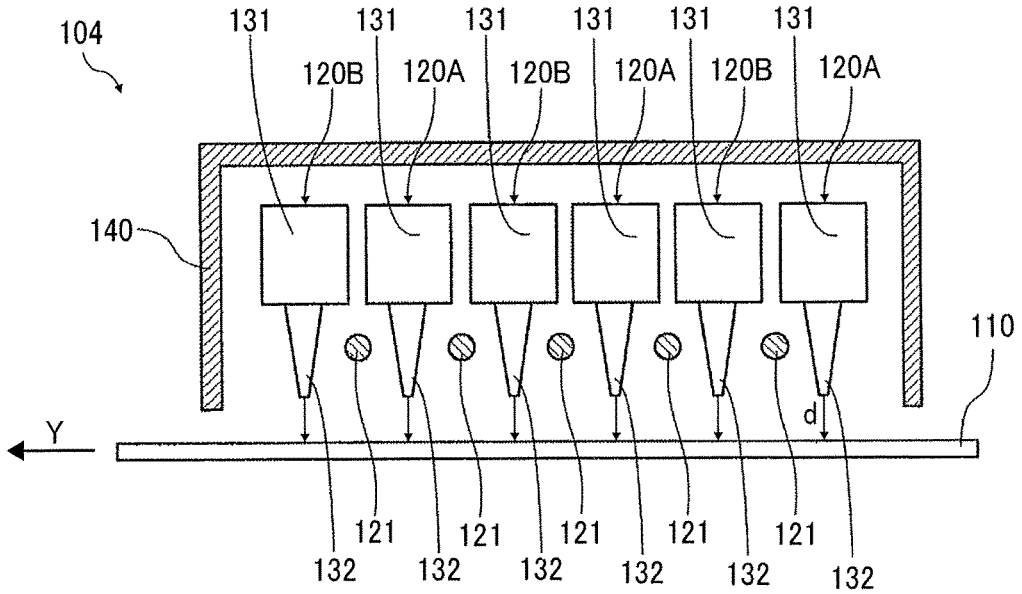
FIG. 3 is a side view of the drying device.
Figure 4:
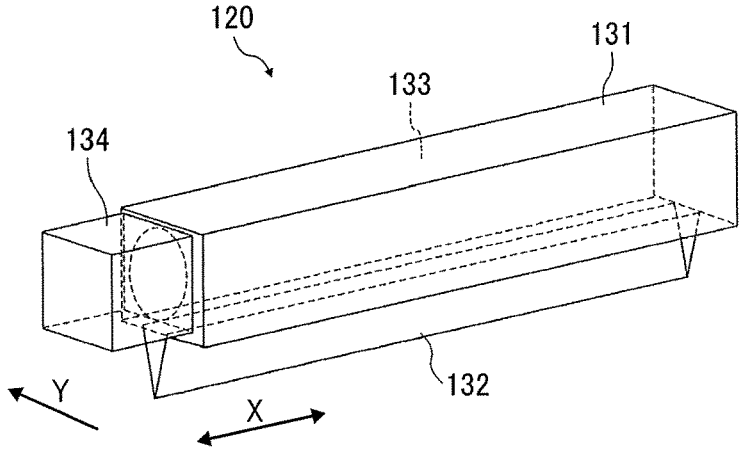
FIG. 4 is a perspective view of an air blower of the drying device.

Next, a drying device according to a first embodiment of the present disclosure is described with reference to FIGS. 2 through 4. FIG. 2 is an enlarged plan view of the drying device 104. FIG. 3 is an enlarged side view of the drying device 104. FIG. 4 is an enlarged perspective view of the drying device 104.

The drying device 104 includes a total of six air knives, 120A and 120B, deployed along the direction of conveyance of the continuous sheet 110 that is an object (member) to be dried. The direction of conveyance of the continuous sheet 110 is indicated by the arrow "Y" in FIG. 2 and is hereinafter referred to as "direction of conveyance Y"). The air knives 120A and the air knives 120B are also referred to as "first blower" and "second blower", respectively. The air knives 120A and 120B serve as blowers to blow air onto the continuous sheet 110.

The drying device 104 also includes radiant heaters 121 disposed outside and between each of the adjacent air knives 120 (see FIGS. 2 and 3). The radiant heaters 121 are heating means for heating the air inside the air knives 120.

As illustrated in FIGS. 2 and 3, each of the air knives 120A and 120B includes an elongated housing 131. Each housing 131 includes an elongated nozzle 132, which is a blowout port having a length corresponding to a width in a direction perpendicular to the direction of conveyance Y. Hereinafter, the direction perpendicular to the direction of conveyance Y is referred to as "nozzle direction" and indicated by arrow X in FIG. 2. Further, each of the air knives 120A and 120B includes a fan 134 at an end in a longitudinal direction of the housing 131. The fan 134 serves as an airflow generator for generating airflow blown from the nozzle 132. The airflow is generated by suctioning (supplying) air to an inner space (chamber) 133 of the housing 131.

As the fans 134 serve as an airflow generator, for example, a counter-rotating fan or the like may be used by obtain a large air volume.

As illustrated in FIG. 4, the air knives 120A are first blowers in each of which a fan 134 is disposed at one end (first end) in the nozzle direction X perpendicular to the direction of conveyance Y of the continuous sheet 110. Air flow is generated in a direction indicated by arrow "a" (see FIG. 2) inside the housing 131 by the fan 134 of each of the air knives 120A. An air current is discharged (blown out) from the nozzle 132 in a downward direction indicated by arrow "d" in FIG. 3.

Conversely, as illustrated in FIG. 2, the air knives 120B are second blowers in each of which a fan 134 is disposed at one end (second end) in the nozzle direction X perpendicular to the direction of conveyance Y of the continuous sheet 110. The first end of the air knives 120A disposed opposite the second end of the air knives 120B in the nozzle direction. Air flow is generated in a direction indicated by arrow "b" (see FIG. 2) inside the housing 131 by the fan 134 of each of the air knives 120A. An air current is discharged (blown out) from the nozzle 132 in a downward direction indicated by arrow in FIG. 3.

Each of the air knives 120A and each of the air knives 120B is disposed alternately along the direction of conveyance Y of the continuous sheet 110. The air knives 120A are the first blowers, and the air knives 120B are the second blowers. In FIG. 2, the air knives 120A and 120B are alternately arranged. Alternatively, a group of two or more air knives 120A and a group of two or more air knives 120B may be alternately arranged.

Each of the radiant heaters 121 is disposed between the adjacent air knives 120A and 120B in the direction of conveyance Y. That is, the air knives 120A and 120B and the radiant heaters 121 are disposed alternately. Thus, one radiant heater 121 can heat the air inside the two adjacent air knives 120A and 120B. Alternatively, the radiant heaters 121 may be arranged between every two air knives 120A and 120B, for example.

The radiant heaters 121 are preferably either infrared heaters that radiate infrared rays having a maximum wavelength in an absorption wavelength band of moisture contained in the liquid, or carbon heaters using carbon as the material of a heating element.

These plurality of air knives 120A and 120B and radiant heaters 121 are surrounded by a device housing 140.

Next, an operation of the drying device 104 is described below.

The continuous sheet 110 onto which the liquid is applied by the liquid applicator 101 is conveyed in the direction of conveyance Y and passes through the drying device 104.

By activating the radiant heaters 121, the drying device 104 directly heats the conveyed continuous sheet 110 with radiant heat provided from the radiant heaters 121.

Further, the air inside the housing 131 of the air knives 120A and 120B is heated by the radiant heat of the radiant heaters 121. By driving the fan 134 to inhale inside the housing 131, the air (warm air) is blown in the downward direction indicated by the arrow "d" from the nozzle 132. The air blown out from the nozzle 132 is blown onto the conveyed continuous sheet 110.

Thus, the liquid on the continuous sheet 110 is heated so that a vapor pressure in the liquid is raised. In this way, the continuous sheet 110 is dried by the drying device 104.

At this time, since the radiant heaters 121 and the air knives 120A and 120B are alternately arranged, the air current (collision jet) blown out from the air knives 120A and 120B prevents excessive heating of the continuous sheet 110 due to radiant heat from the radiant heaters 121.

As illustrated in FIGS. 2 and 4, the housing 131 of the air knives 120A and 120B has an elongated inner space 133. Thus, with increase in a distance in the housing 131 from the fan 134 disposed at the end of the housing 131 in the nozzle direction X, time of heating the inner space 133 of the housing 131 with the radiant heat of the radiant heaters 121 increases. Thus, temperature at a position far from the fan 134 in the inner space 133 of the housing 131 becomes relatively high.

The temperature of the airflow blown out from the nozzle 132 is relatively low on the fan 134 side and is relatively high on the side opposite the fan 134 in the nozzle direction X of the housing 131. Thus, uneven heating (drying unevenness) occurs in the longitudinal direction (nozzle direction X) of the housing 131.

Therefore, in the present embodiment, the air knives 120A, and the air knives 120B, which is the second air blowing means in which the fan 134 is disposed on the other end side, are disposed alternately. The air knives 120A are the first air blower in which the fan 134 is disposed on the first end of the air knives. The air knives 120B are the second air blower in which the fan 134 is disposed on the second end of the air knives 120B. The first end of the air knives 120A disposed opposite the second end of the air knives 120B in the nozzle direction X.

Thus, overall heating unevenness (drying unevenness) can be reduced in the nozzle direction X. The nozzle direction X is a width direction of the conveyed continuous sheet 110 and is a direction perpendicular to the direction of conveyance Y of the continuous sheet 110. Thus, the drying device 104 can prevent an excessive heating of the continuous sheet 110 on the same side in the width direction of the conveyed continuous sheet 110 with relatively hot air blown from the air knives 120A and 120B. Thus, the drying device 104 can prevent damages such as yellowing of the object to be dried (continuous sheet 110) by the excessive heating.

Figure 5:
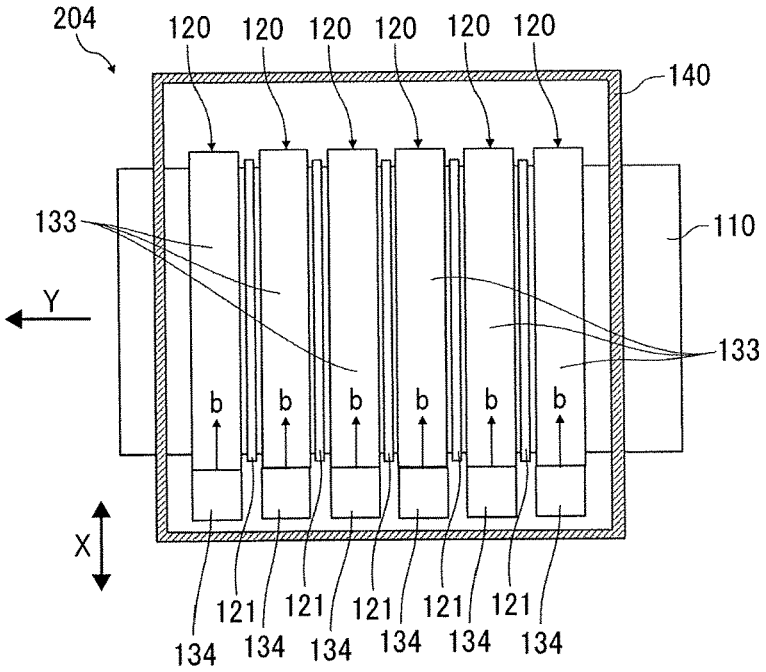
FIG. 5 is a plan view of a comparative example 1.

Here, a drying device 204 in a comparative example 1 is described with reference to FIG. 5. FIG. 5 is a plan view of the drying device 204 of the comparative example 1.

In this comparative example 1, all of the fans 134 are disposed at the same end (lower end in FIG. 5) of the housing 131 of the air knives 120 in the nozzle direction X perpendicular to the direction of conveyance Y.

Thus, the drying device 204 excessively heats the same side of the continuous sheet 110 in the nozzle direction X (width direction of the continuous sheet 110) with relatively hot air blown from the air knives 120. Thus, the drying device 204 causes damage such as yellowing of the continuous sheet 110 by the excessive heating.

Conversely, the positions of the fans 134 alternately change for every one of the air knives 120 in the nozzle direction X in the present embodiment. The positions of the fans 134 may alternately change for every two or more of the air knives 120 in the nozzle direction X in the present embodiment. Thus, the drying device 104 can prevent the excessive heating of the same side of the continuous sheet 110 in the nozzle direction X (width direction) with relatively hot air constantly blown from the air knives 120A and 120B.

Further, the positions of the fans 134 (air flow generator) alternately changes in the nozzle direction X in the present embodiment. Thus, even when the drying device 104 includes the fans 134 (airflow generator) larger than the housing 131, the present configuration of the drying device 104 can prevent the fan 134 from interfering between the adjacent air knives 120.

Thus, the drying device 104 can narrow an interval between the adjacent air knives 120 and reduce the size of the device.

Next, a drying device 104 according to a second embodiment of the present disclosure is described with reference to FIGS. 6A through 8.

Figure 6A:
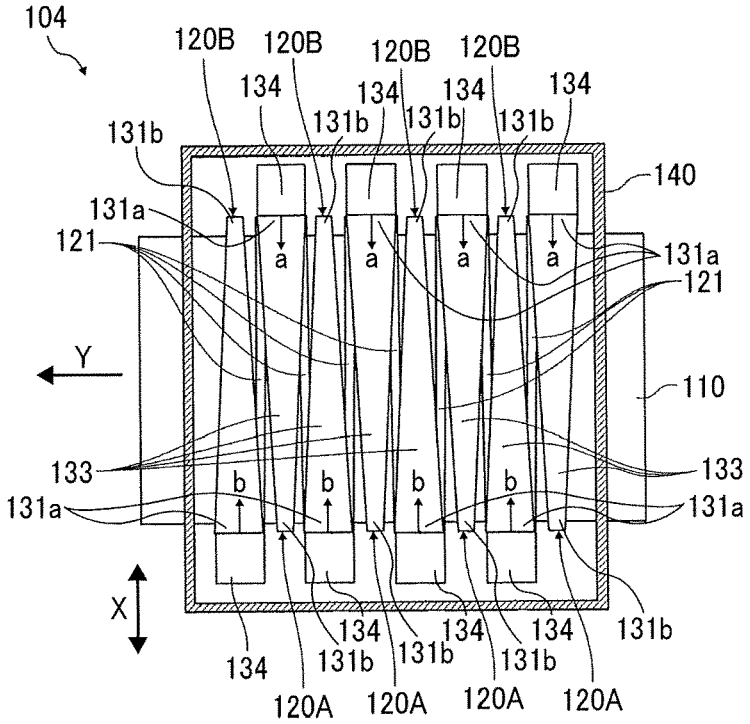
FIGS. 6A through 6C are plan views of the drying device according to a second embodiment of the present disclosure.
Figure 6B:
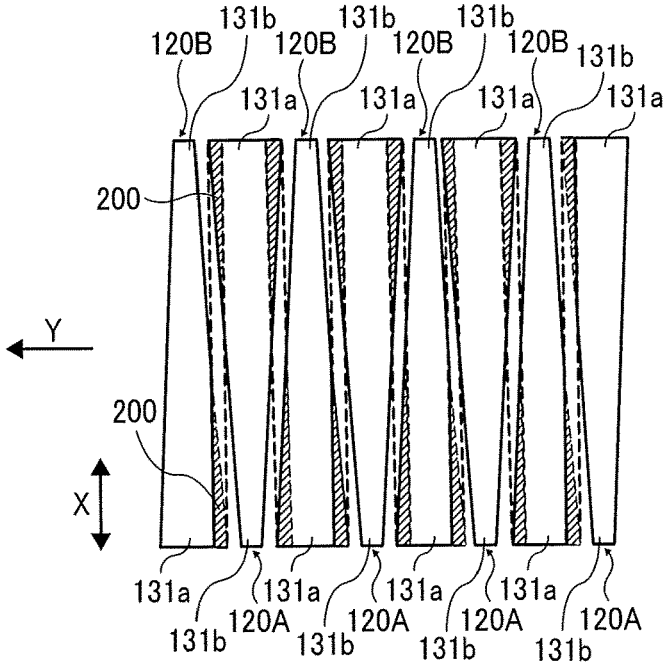
Figure 6C:
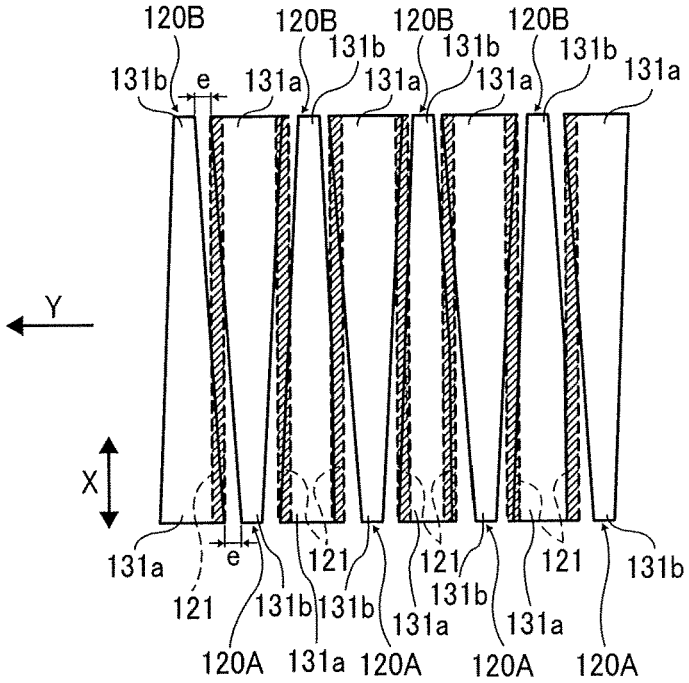
Figure 7:
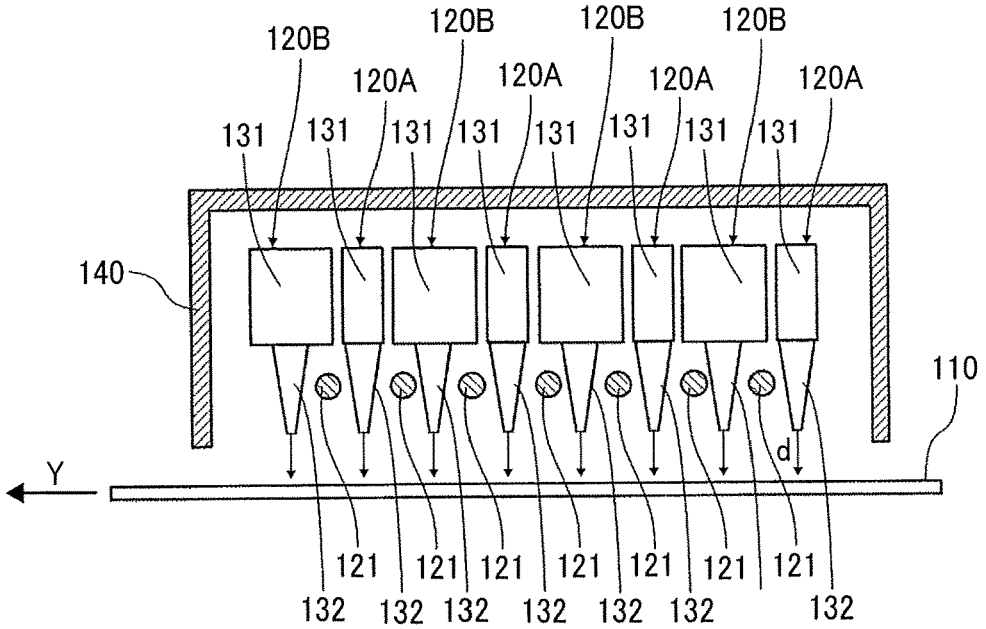
FIG. 7 is a side view of the drying device according to the second embodiment.
Figure 8:
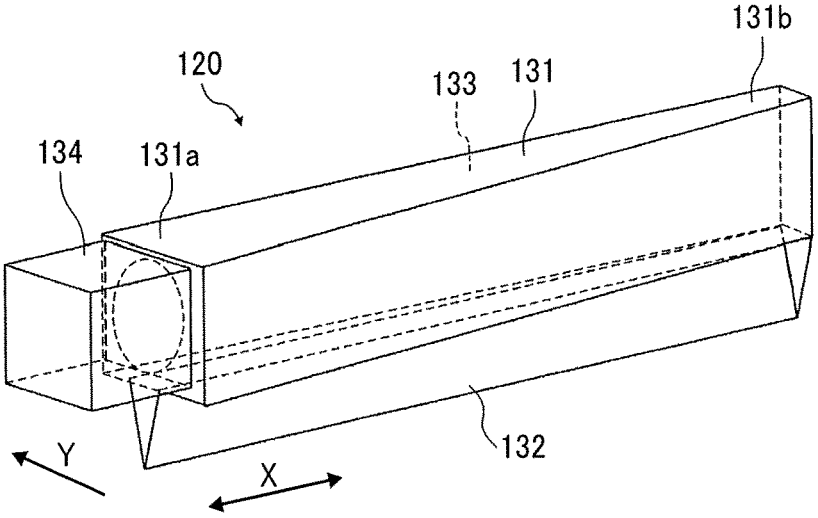
FIG. 8 is a perspective view of the air blower of the drying device.

FIGS. 6A through 6C are enlarged plan views of the drying device 104. FIG. 7 is an enlarged side view of the drying device 104. FIG. 8 is an enlarged perspective view of the drying device 104.

In the second embodiment, each of the housings 131 of the air knives 120A and 120B has an outer shape including a wide portion 131*a* formed at one end of the housing 131 and a narrow portion 131*b* formed at another end of the housing 131. A width of the wide portion 131*a* is wider than a width of the narrow portion 131*b* in the direction of conveyance Y.

The fans 134 as the airflow generators are disposed on the wide portion 131*a* side of the housing 131. Therefore, each of the housings 131 of the air knives 120A and 120B have a tapered outer shape in which the width of the housing in the direction of conveyance Y decreases with increase of the distance from the fan 134 in the nozzle direction X.

The air knives 120A and 120B adjacent to each other in the direction of conveyance Y are arranged such that the wide portion 131*a* of the air knives 120A is adjacent to the narrow portion 131*b* of the air knives 120B. In FIGS. 6A through 6C, four air knives 120A as the first air blowers and four air knives 120B as the second air blowers are disposed adjacently and alternately.

Thus, each of the housings 131 of the air knives 120A (first blowers) and the air knives 120B (second blowers) includes a wide portion 131*a* formed at one end of the housing 131 and a narrow portion 131*b* formed at another end of the housing 131, a width of the wide portion 131*a* being wider than a width of the narrow portion 131*b* in the direction of conveyance Y.

The wide portions 131*a* at the one end of the housings 131 of the air knives 120A (first blowers) and the narrow portions 131*b* at the one end of the housings 131 of the air knives 120B (second blowers) are disposed alternately in the direction of conveyance Y. The narrow portions 131*b* at the other end of the housings 131 of the air knives 120A (first blowers) and the wide portions 131*a* at the other end of the housings 131 of the air knives 120B (second blowers) are disposed alternately in the direction of conveyance Y.

That is, the wide portion 131*a* at the one end of the housing 131 of the air knife 120A (first blower) is adjacent to the narrow portion 131*b* at the one end of the housing 131 of the air knife 120B (second blower) in the direction of conveyance Y. The narrow portion 131*b* at the other end of the housing 131 of the air knife 120A (first blower) is adjacent to the wide portion 131*a* at the other end of the housing 131 of the air knife 120B (second blower) in the direction of conveyance Y.

In FIGS. 6A through 6C, the housings 131 of the two air knives 120A and 120B adjacent in the direction of conveyance Y overlap in the nozzle direction X. Specifically, the wide portions 131*a* at the one end of the housing 131 of the air knives 120A (first blowers) and the wide portions 131*a* at the other end of the housing 131 of the air knives 120B (second blowers) disposed adjacent in the direction of conveyance overlap in the nozzle direction X as indicated by shaded area 200 in FIG. 6B.

The drying device 104 with thus configured can arrange a plurality of air knives 120A and 120B at a high density in the direction of conveyance Y. Thus, the drying device 104 according to the present embodiment can reduce the size of the drying device 104 and improve a drying capacity by arranging the air knives 120A and 120B at high density.

In the present embodiment, a longitudinal direction of the radiant heaters 121 are arranged along the nozzle direction X perpendicular to the direction of conveyance Y as in FIGS. 6A through 6C. As illustrated in FIG. 6C, a distance between the wide portion 131*a* of the housing 131 and the radiant heater 121 is smaller than a distance "e" between the narrow portion 131*b* of the housing 131 and the radiant heater 121 in the direction of conveyance Y. In FIG. 6C, the wide portion 131*a* of the housing 131 is disposed just above the radiant heater 121, and the distance between the wide portion 131*a* of the housing 131 and the radiant heater 121 is zero. The fan 134 is disposed at the wide portion 131*a* and is not disposed at the narrow portion 131*b* of the housing 131 of each of the air knives 120A and 120B.

Therefore, the separation between the inner space 133 of the housing 131 and the radiant heater 121 increases with an increase in the distance from the fan 134 in the nozzle direction X. Thus, the drying device 104 can minimize a temperature rise in the inner space 133 due to the increase in the distance from the fan 134. Thus, the drying device 104 can reduce the temperature difference of the airflow blown from the nozzle 132 of the air knives 120A and 120B between the wide portion 131*a* side and the narrow portion 131*b* side of the housing 131 in the nozzle direction X perpendicular to the direction of conveyance Y.

Figure 9:
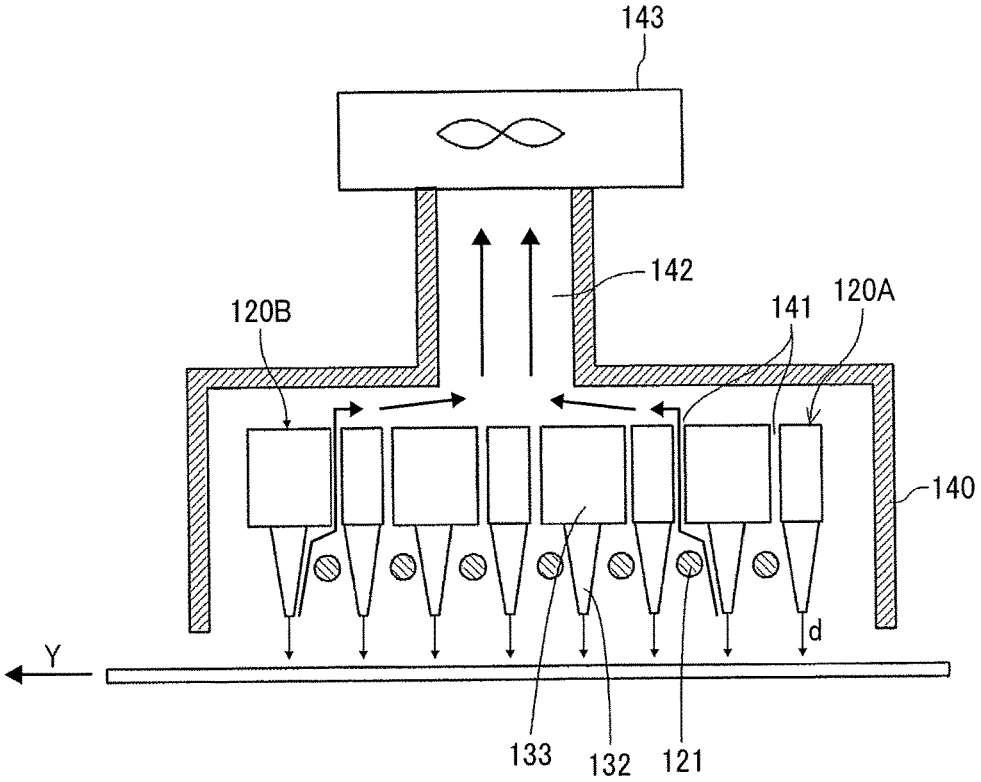
FIG. 9 is a side view of the drying device according to a third embodiment of the present disclosure.

The drying device 104 according to a third embodiment of the present disclosure is described with reference to FIG. 9. FIG. 9 is an enlarged side view of the drying device 104.

Note that the arrangement of the air knives 120A and 120B and the radiant heaters 121 in the third embodiment is the same as the arrangement of the air knives 120A and 120B and the radiant heaters 121 in the second embodiment. However, the arrangement of the air knives 120A and 120B and the radiant heaters 121 in the third embodiment may be same as the arrangement in the first embodiment or other arrangements in other embodiments as described below.

In FIG. 9, at least one of the radiant heaters 121 is disposed between adjacent air knives 120A (first blowers) and 120B (second blowers). Thus, a passage 141 is secured (formed) between the adjacent air knives 120A (first blowers) and 120B (second blowers) above the radiant heaters 121. That is, the passage 141 is formed in a gap between the housings 131 of the air knives 120A and 120B (blowers) adjacent in the direction of conveyance Y.

An exhaust channel (exhaust port) 142 communicating with the inner space 133 of the device housing 140 is provided on a top surface of the device housing 140. An exhaust fan 143 as an exhaust is attached to the exhaust channel 142. The exhaust channel 142 may be connected with a duct and further connected to the exhaust fan 143 as the exhaust.

In the configuration as illustrated in FIG. 9, vapor evaporated from the continuous sheet 110 is exhausted outside the device housing 140 through the passage 141 and the exhaust channel 142. The vapor is air containing solvent or moisture or the like.

Figure 10:
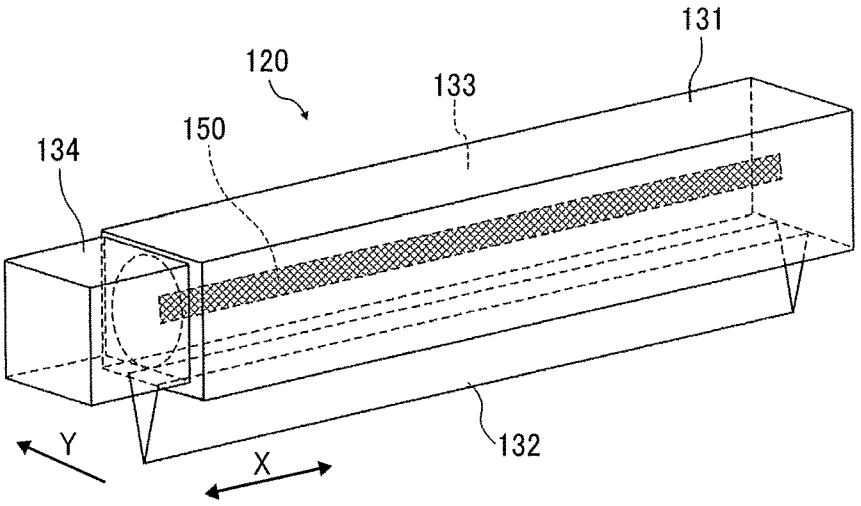
FIG. 10 is a perspective view of the air blower of the drying device according to a fourth embodiment of the present disclosure.

The drying device 104 according to a fourth embodiment of the present disclosure is described with reference to FIG. 10. FIG. 10 is an enlarged perspective view of the air knives 120A and 120B of the drying device 104.

The air knives 120A and 120B in the fourth embodiment includes a heating element 150 as a heater for heating the air in the inner space 133. The heating element 150 is disposed in the inner space 133 of the housing 131. Examples of the heating element 150 include a sheathed heater in which a nichrome wire (heating element) is wrapped with a metal pipe, a ceramic heater, a carbon heater, and the like.

The outer shape of the housing 131 can also be same as the outer shape in the second embodiment as illustrated in FIGS. 6 through 8.

Figure 11:
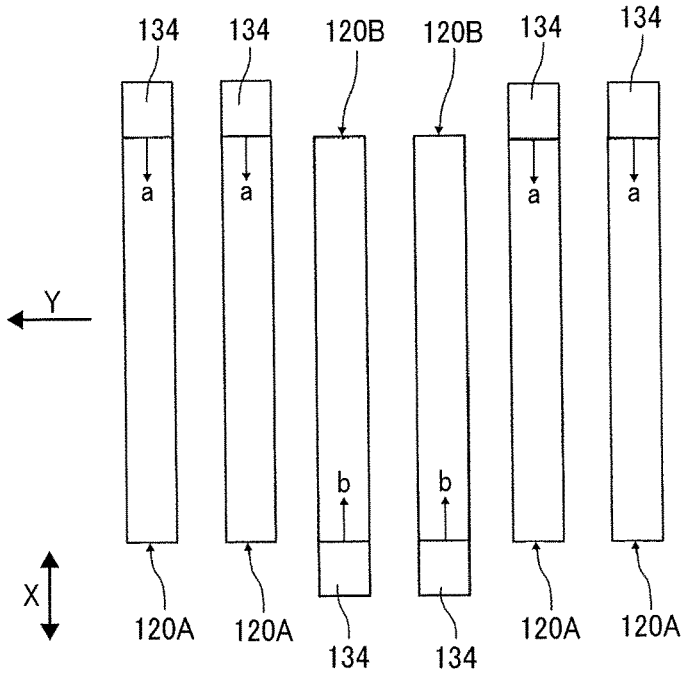
FIG. 11 is a plan view of the drying device according to a fifth embodiment of the present disclosure.

The drying device 104 according to a fifth embodiment of the present disclosure is described with reference to FIG. 11. FIG. 11 is an enlarged plan view of the drying device 104.

In the present embodiment, a group of a plurality of air knives 120A and a group of a plurality of air knives 120B are alternately arranged. In FIG. 11, two air knives 120A and two air knives 120B are alternately arranged as an example. That is, N number of fans 134 (air blowers) of the air knives 120A arranged in series in the direction of conveyance Y vacuums air from the same direction as indicated by arrow "a" in FIG. 11. Further, another N number of fans 134 (air blowers) of the air knives 120B arranged in series in the direction of conveyance Y vacuums air from the direction as indicated by arrow "b" in FIG. 11 that is opposite to the direction "a" of vacuuming the air in the air knives 120A.

Figure 12:
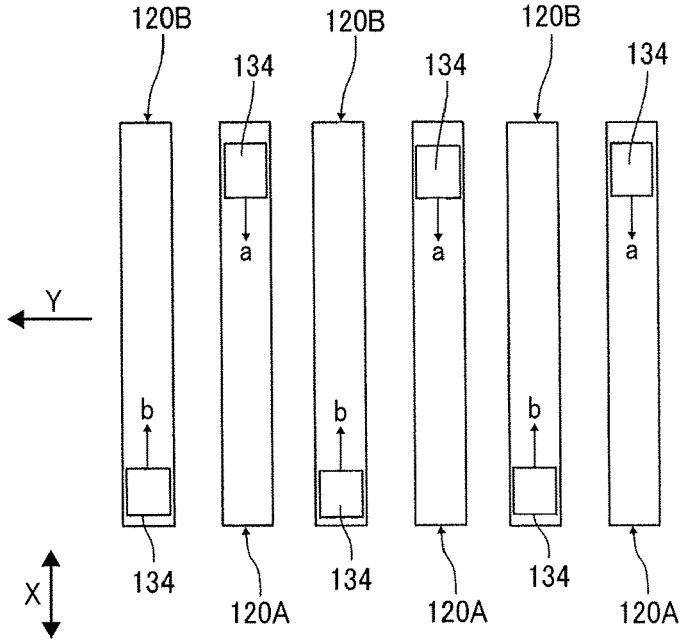
FIG. 12 is a plan view of the drying device according to a sixth embodiment of the present disclosure.
Figure 13:
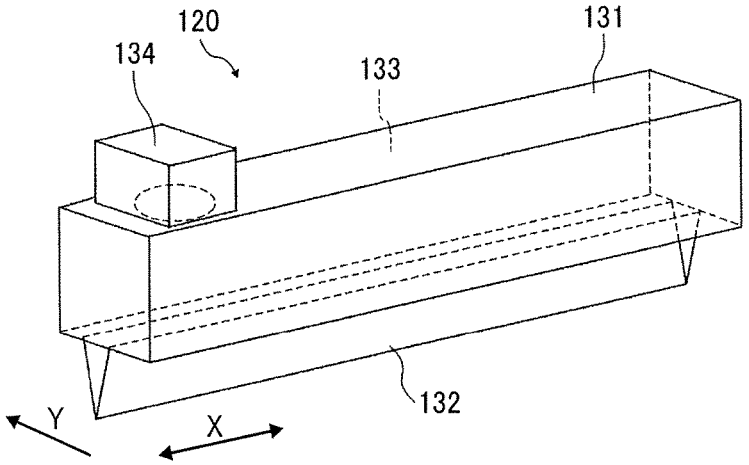
FIG. 13 is a perspective view of the air blower of the drying device.

The drying device 104 according to a sixth embodiment of the present disclosure is described with reference to FIGS. 12 and 13. FIG. 12 is an enlarged plan view of the drying device 104. FIG. 13 is an enlarged perspective view of the air knives 120A and 120B of the drying device 104.

In the sixth embodiment, each of the air knives 120A as the air blowers includes a fan 134 as an airflow generator on a top surface of one end portion (first end portion) of the housing 131. Further, each of the air knives 120B as the air blowers includes the fan 134 as the airflow generator on the top surface of the other end portion (second end portion) of the housing 131. The first end portion disposed opposite the second end portion in the nozzle direction X as illustrated in FIG. 12.

Similarly to the first embodiment in FIG. 2, the air knives 120A and 120B are alternately arranged along the direction of conveyance Y in the sixth embodiment in FIG. 12. Thus, the fans 134 (airflow generators) are alternately arranged in the first end (upper side in FIG. 12) and the second end (lower side in FIG. 12) in the nozzle direction X (perpendicular to the direction of conveyance Y) along the conveying direction Y. The arrangement of the air knives 120A and 120B as described in the fifth embodiment in FIG. 11 may also be adapted to the sixth embodiment in FIG. 12. In this way, even when the fan 134 (airflow generator) is disposed on the top surface of the end portion (first end or second end) of the air knives 120A and 120B in the nozzle direction X as described above, an effect as same as in the first embodiment can be obtained.

Figure 14:
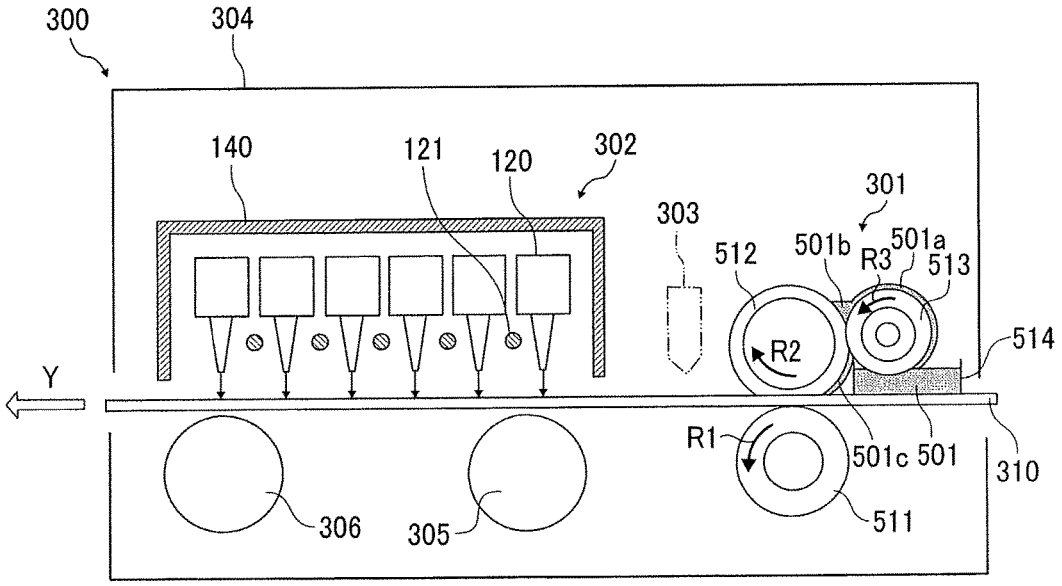
FIG. 14 is a side view of a treatment liquid applicator according to a seventh embodiment of the present disclosure.

A seventh embodiment according to the present disclosure is described with reference to FIG. 14. FIG. 14 is a side view of a treatment liquid applicator 300 according to the seventh embodiment of the present disclosure.

The treatment liquid applicator 300 includes a coating device 301 for applying a treatment liquid to an object 310 to be dried and a drying device 302 according to the present disclosure for drying the object 310 to be dried coated with the treatment liquid in an applicator housing 304. Further, the treatment liquid applicator 300 includes conveyance rollers 305 and 306 for conveying the object 310 to be dried.

As the treatment liquid, for example, there is a modifying material to modify a surface of the object 310 to be dried by being applied to the surface of the object 310 to be dried. Specifically, there is a fixing agent (setting agent), in which, by preliminarily applying the fixing agent to the object 310 to be dried uniformly, the moisture of the ink is quickly permeated into the object 310 to be dried, the color component is thickened, and the drying is accelerated to prevent bleeding (feathering, bleeding, or the like) or strike-through. Thus, the fixing agent can enhance productivity (the number of images output per unit time).

As a composition of the treatment liquid, for example, a solution to which cellulose that promotes penetration of moisture and a base material such as talc fine powder are added to surfactant may be used. The cellulose includes, for example, hydroxypropyl cellulose. The surfactant includes, for example, any one of anionic, cationic, and nonionic surfactants, or a mixture of two or more of the foregoing surfactants. Further, treatment liquid may contain fine particles.

The coating device 301 includes a conveyance roller 511 for transporting the object 310 to be dried, an application roller 512 for applying the treatment liquid 501 to the object 310 to be dried, and a squeeze roller 513 for thinning the liquid film (a film of the treatment liquid 501) by supplying the treatment liquid 501 to the application roller 512. The application roller 512 is disposed opposite the conveyance roller 511. The directions of rotation of the conveyance roller 511, the application roller 512, and the squeeze roller 513 are indicated by arrows R1, R2, and R3 in FIG. 14. In these rollers, the application roller 512 is in contact with the conveyance roller 511, and the squeeze roller 513 is disposed in contact with the application roller 512.

When the treatment liquid 501 is applied to the object 310 to be dried by the coating device 301, the squeeze roller 513 rotates in a direction indicated by arrow R3 in FIG. 14. Thus, the treatment liquid 501 in the liquid tray 514 is scooped up on the surface of the squeeze roller 513. The treatment liquid 501 is transported by a rotation of the squeeze roller 513 in a state of a liquid film layer 501*a* and is accumulated on a valley portion (contact portion: nip portion) between the squeeze roller 513 and the application roller 512 as treatment liquid 501*b* in FIG. 14.

Here, the squeeze roller 513 and the application roller 512 are in contact with each other at a constant pressure. The treatment liquid 501*b* stored in the valley portion is squeezed by the pressure when the treatment liquid 501*b* passes between the squeeze roller 513 and the application roller 512. Thus, a liquid film layer 501*c* of the treatment liquid 501 is formed and is transported to the conveyance roller 511 by rotation of the application roller 512. The liquid film layer 501*c* transferred by the application roller 512 is applied to the object 310 to be dried.

The object 310 to be dried coated with the liquid film layer 501*c* of the treatment liquid 501 in this manner is conveyed to the drying device 302 and is dried by the drying device 302. The drying device has the same configuration as the drying device 104 as described in FIGS. 1 through 13. The object 310 to be dried that has undergone the drying treatment by the drying device 302 is sent to the next step (for example, the liquid applicator 101 in the first embodiment).

Further, a liquid which is cured by irradiant with an active energy ray such as ultraviolet ray or the like may be used as the treatment liquid 501. In this case, an exposure light source 303 as an exposure device is disposed between the coating device 301 and the drying device 302. The exposure light source is indicated by two-dot dashed line in FIG. 14.

After applying the treatment liquid 501 to the object 310 to be dried, the treatment liquid 501 is partially cured (semi-cured) by irradiating the treatment liquid 501 with the active energy ray from the exposure light source 303. Then, the treatment liquid 501 can be dried in the drying device 302. This structure is particularly effective for the treatment liquid 501 containing a photopolymerization initiator and having a high moisture content.

As the photopolymerization initiator contained in the treatment liquid 501, a photo-radical polymerization initiator is preferable. Examples of the photopolymerization initiator include, but are not limited to, aromatic ketones, phosphine oxide compounds, aromatic onium salt compounds, organic peroxides, thio compounds, hexaaryl biimidazole compounds, ketoxime ester compounds, borate compounds, azinium compounds, metallocene compounds, active ester compounds, carbon-halogen-bond-containing compounds, and alkylamine compounds.

Examples of the active energy ray irradiated by the exposure light source 303 include, but are not limited to, ultraviolet ray, visible light, α-ray, γ-ray, X-ray, and electron ray. Examples of exposure light source 303 for active energy rays include mercury lamps, metal halide lamps, light emitting diodes, laser diodes, and the like.

Note that the coating device 301 may apply liquid using the liquid discharge heads 111.

In each of the above embodiments, the air knives 120A and 120B as the air blowers are arranged in the nozzle direction X perpendicular to the direction of conveyance Y. However, the air knives 120A and 120B as the air blowers may be arranged in a direction diagonally intersecting the direction of conveyance Y (with an angle other than 90 degree).

In each of the above-described embodiments in FIGS. 1 through 13, the continuous sheet 110 is described as an example of the object 310 to be dried (the object to be heated, the member to be conveyed, etc.). However, the object 310 to be dried is not limited to the continuous sheet 110, and any member to be heated by the drying device 104 according to the present disclosure may be substituted. For example, the object 310 to be dried may be a continuous body such as continuous paper, roll paper, and web, cut sheet material, wall paper, a sheet for electronic circuit board such as prepreg, or the like.

The liquid applicator 101 may record an image such as characters or figures on the object to be dried with a liquid such as ink. The liquid applicator 101 may also apply an image having no meaning such as a pattern with a liquid such as ink for the purpose of decoration and decoration.

Here, the liquid to be applied on the object 310 to be dried is not particularly limited, but it is preferable that the liquid has a viscosity of less than or equal to 30 mPa·s under a normal temperature and a normal pressure or by being heated or cooled. Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such liquids can be used as inkjet inks, surface treatment liquids, liquids for forming compositional elements of electric or luminous elements or electronic circuit resist patterns, and 3D modeling material liquids.

When a liquid discharge head is used as the liquid applicator, examples of an energy generation source used in the liquid discharge head include a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A drying device comprising:

a plurality of blowers to blow air onto an object to be dried, the plurality of blowers being disposed along a direction of conveyance of the object to be dried; and a plurality of heaters to heat air inside the plurality of blowers, wherein each of the plurality of blowers includes:

an elongated nozzle arranged along a nozzle direction perpendicular to the direction of conveyance of the object to be dried;

an airflow generator to generate airflow to be blown from the elongated nozzle; and a housing, wherein the plurality of blowers includes:

a first blower including the airflow generator at a first end of the first blower in the nozzle direction; and a second blower including the airflow generator at a first end of the second blower in the nozzle direction, the first end of the second blower being opposite the first end of the first blower in the nozzle direction, wherein the housing of the first blower includes a wide portion formed at a first end of the housing of the first blower in the nozzle direction and a narrow portion formed at a second end of the housing of the first blower in the nozzle direction, a width of the wide portion of the housing of the first blower being wider than a width of the narrow portion of the housing of the first blower in the direction of conveyance, the airflow generator of the first blower at the first end of the first blower being adjacent to the first end of the housing of the first blower such that air flow within the housing of the first blower flows from the first end of the housing of the first blower to the second end of the housing of the first blower in the nozzle direction, wherein the housing of the second blower includes a wide portion formed at a first end of the housing of the second blower in the nozzle direction and a narrow portion formed at a second end of the housing of the second blower in the nozzle direction, a width of the wide portion of the housing of the second blower being wider than a width of the narrow portion of the housing of the second blower in the direction of conveyance, the airflow generator of the second blower at the first end of the second blower being adjacent to the first end of the housing of the second blower such that air flow within the housing of the second blower flows from the first end of the housing of the second blower to the second end of the housing of the second blower in the nozzle direction, wherein the wide portion at the first end of the housing of the first blower is adjacent to the narrow portion at the second end of the housing of the second blower in the direction of conveyance, and wherein the narrow portion at the second end of the housing of the first blower is adjacent to the wide portion at the first end of the housing of the second blower in the direction of conveyance.

2. The drying device according to claim 1, wherein the first blower includes a plurality of first blowers; and the second blower includes a plurality of second blowers, wherein the plurality of first blowers and the plurality of second blowers are disposed alternately in the direction of conveyance.

3. The drying device according to claim 1, wherein the first blower includes a plurality of first blowers; and the second blower includes a plurality of second blowers, wherein a group of the plurality of first blowers and a group of the plurality of second blowers are disposed alternately in the direction of conveyance.

4. The drying device according to claim 1, wherein the wide portion at the first end of the housing of the first blower and the wide portion at the first end of the housing of the second blower disposed adjacent in the direction of conveyance overlap in the nozzle direction.

5. The drying device according to claim 1, wherein at least one of the plurality of heaters is disposed between the first blower and the second blower; and a passage is formed between the first blower and the second blower adjacent to each other above the plurality of heaters.

6. The drying device according to claim 5, wherein the passage is a gap formed between the housing of the first blower and the housing of the second blower adjacent to each other in the direction of conveyance.

7. The drying device according to claim 1, the object to be dried is conveyed to the drying device after liquid is applied onto the object to be dried.

8. A liquid discharge apparatus, comprising:

the drying device according to claim 7; and a liquid applicator to apply the liquid onto the object to be dried.

9. A treatment liquid applicator, comprising:

the drying device according to claim 7; and a liquid applicator to apply treatment liquid as the liquid onto the object to be dried.

10. The drying device according to claim 1, wherein a width of a top of the elongated nozzle is greater than a width of a bottom of the elongated nozzle in the direction of conveyance.

* * * * *